United States Patent [19]

Yahalom et al.

[11] Patent Number: 4,652,348

[45] Date of Patent: Mar. 24, 1987

[54] METHOD FOR THE PRODUCTION OF ALLOYS POSSESSING HIGH ELASTIC MODULUS AND IMPROVED MAGNETIC PROPERTIES BY ELECTRODEPOSITION

[75] Inventors: Joseph Yahalom, Haifa; Ori Zadok, Tel-Aviv, both of Israel

[73] Assignee: Technion Research & Development Foundation Ltd., Haifa, Israel

[21] Appl. No.: 815,860

[22] Filed: Jan. 3, 1986

[30] Foreign Application Priority Data

Oct. 6, 1985 [IL] Israel ..... 76592

[51] Int. Cl.[4] ..... C25D 5/10; C25D 5/12

[52] U.S. Cl. ..... 204/40; 204/DIG. 9

[58] Field of Search ..... 204/40, 41, DIG. 9

[56] References Cited

U.S. PATENT DOCUMENTS 3,480,522 11/1969 Brownlow ..... 204/40

FOREIGN PATENT DOCUMENTS 1136493 12/1968 United Kingdom ..... 204/40
1210270 10/1970 United Kingdom ..... 204/DIG. 9
1433850 4/1976 United Kingdom ..... 204/40

OTHER PUBLICATIONS

T. Tsakalos et al., "Interdiffusion in Composition Modulated Copper-Nickel Thin Films", *J. Phys., Collog.*, 1977, 7, 404–405.

D. Baral et al., "Historical Survey of Artificially Prepared Composition Modulated Structures," from Ph.D Thesis entitled On the Mechanical and Thermoelectric Behavior of Composition Modulated Foils, Northwestern Univ., Jun. 1983.

D. Baral et al., "On the Mechanical and Thermoelectric Behavior of Composition Modulated Foils," *Dissertation Abstracts International*, vol. 44/09-B, p. 2858.

D. Tench et al., "Enhanced Tensile Strength for Electrodeposited Nickel-Copper Multilayer Composites," *Metallurgical Transactions A*, vol. 15A, Nov. 1984, 2039–40.

*Primary Examiner*—G. L. Kaplan

*Attorney, Agent, or Firm*—Browdy and Neimark

[57] ABSTRACT

The present invention relates to a method for the electrodeposition of an ordered alloy structured in alternate discrete layers said alloys possessing high elastic modulus and adjustable magnetic susceptibility. According to the invention, the electrodeposition of at least two metals, characterized by a redox potential gap of at least 0.1 V between said metals, is obtained by the pulse plating technique with a frequency in the range of 0.02 Hertz to 15 Hertz. The concentrations of the noblest metal in the electrodeposition solution should be in the range of 0.001M to 2.0M while that of the less noble metal is about its saturation at room temperature. The discrete layers obtained according to the method are less than 90 Angstroms thickness, being substantially pure. Examples of the metals to be electrodeposited according to the invention are copper-nickel; copper-palladium; nickel-gold; copper-nickel-iron and corresponding alloys with cobalt or iron replacing nickel.

10 Claims, No Drawings

METHOD FOR THE PRODUCTION OF ALLOYS POSSESSING HIGH ELASTIC MODULUS AND IMPROVED MAGNETIC PROPERTIES BY ELECTRODEPOSITION

BACKGROUND OF THE INVENTION

The present invention relates to a new method for the production of alloys possessing high elastic modulus and high magnetic properties. More particularly, the invention relates to a new method for the production of ordered alloys possessing high elastic modulus and high magnetic properties by electrodeposition.

As known, electrodeposition (or electroplating) is defined as the art of production of metallic deposits through the action of electric current on a solution containing the respective metal ions to be deposited. Such coatings have the purpose of improving the appearance, corrosion resistance, hardness, bearing qualities or other properties of the basic metals, on which the coating is produced, or can be detached from the substrate and be used as tools in view of their special properties.

The technique of electroplating is widely used in many fields. There are specific cases such as springs, magnets or apparatus which require high or controlled modulus of elasticity or magnetism, when ordered alloys containing of two or more metals in alternating layers up to 100 Å thickness will have to be electrodeposited on a particular substrate. The use of the common electroplating techniques, i.e., the deposition of a layer of one metal in one bath followed by the electrodeposition of a second layer of another metal in another bath, may be conceived theoretically, but practically it is not applicable due to the long duration time which the operation of electrodeposition will involve and the complexity involved. Usual deposition of two metals from a common bath results in the production of alloys that are not ordered or structured in discrete layers of the practically pure components of the objects to be coated, or the layers are not thin enough to acquire the necessary elastic or magnetic properties.

A few years ago, a proposal was made for obtaining composition modulated alloys which possess the required properties of elasticity and magnetism, using the technique of vapor deposition (T. Tsakalakos et. al., J. Physique C-7, 404, 1977). According to this method, composition modulated layers of copper-nickel were prepared by co-evaporating the two components through a rotating pinwheel shutter onto a mica substrate at a temperature of 350 degrees centigrade. But the method has various disadvantages, e.g. high cost of production, and limitations in size and shape of the objects to be coated.

The essential parts of a typical electroplating system are:

(1) the plating bath which contains a compound of the metal to be deposited;
(2) a source of direct current electricity;
(3) the substrate to be coated; and
(4) a counter electrode.

The negative terminal of the direct current source, is connected to the substrate (the cathode) while the positive terminal is connected to the counter electrode (the anode). When both of these electrodes are immersed in the plating bath, oxidation occurs at the anode and metal ions migrate to the cathode surface and are transformed to the metallic state and attached to that surface.

The thickness of a plated coating is determined by the time of electroplating and the current density employed.

The pulse plating technique is a recognized method in the electroplating industry. The method consists in the turning on and off continuously in rapid succession the current applied to the electroplating bath. During the pulse "on" time, the ions are electroplated out of solution at the cathode interface. During the pulse "off" time, the solution near the cathode interface becomes replenished with metal ions.

The technique of electrodeposition of two or more individual metals from one single solution, each metal to be deposited in a substantially pure form in such a way as to obtain enhanced modulus of elasticity and magnetism was unknown prior to the present invention. The reason why such attempts could not succeed, was explained by a thermodynamical assumption based on the fact that the noblest metal will deposit simultaneously with the less noble metal, or that the deposition of alternate layers at the required thickness was impossible by electrodeposition.

In a very recent paper by D. Tench and J. White (Metallurgical Transactions A. Vol. 15A, November 1984, p. 2039–40) composites of Ni-Cu layers are described which were electrodeposited from a bath, mentioning their enhanced tensile strength. The composites consisted actually of a rigid material (i.e. Ni) embedded in a soft matrix (i.e. Cu) like many known composites, and had neither enhanced modulus of elasticity nor any improved magnetic properties. Therefore, these composites could never be utilized for special applications requiring these properties.

SUMMARY OF THE INVENTION

It is an object of the present invention to provide a method for the production of compositions of modulated ordered alloys by electrodeposition. It is another object of the present invention to provide a simple method for the electrodeposition of at least two metals from solutions containing the respective metal salts possessing enhanced modulus of elasticity and magnetism. Thus, the invention consists in a method for the electrodeposition of an ordered alloy structured in alternate discrete layers of at least two metals from a solution containing the salts of the respective metals, said metals being characterized by a redox potential gap of at least 0.1 V between the noblest metal and the less noble one, utilizing the pulse plating technique, with a frequency in the range of 0.02 to 15 Hertz, wherein the concentration of the noblest metal present in said solution is in the range of 0.001M to 2M. It was found that by utilizing the pulse plating technique, it is possible to work with a pulse current having a potential which will be positive enough to deposit the noblest metal but not the less noble metal, followed by a pulse current with a more negative potential, whereby substantially only the less noble metal will be deposited at which time the nobler metal deposition is restrained by a diffusion barrier. In this way it is possible to achieve a modulated electrodeposition of two distinct layers of the metals present in a solution wherein each discrete layer is less than 90 Angstroms thick. The frequency of pulsing and the ratio of pulse durations are set at such a value as to produce layers of thickness in the orders of between 2 and 90 Angstroms and preferably up to 50 Angstroms each.

The concentration of the noblest metal in the solution, from which the modulated alloys are electrodeposited, should be in the range of 0.001M to 2M and preferably in the range of 0.005M to 1M. Concentrations below 0.001M will require excessive time for the metal deposition, and this will not be practical from an economic point of view. On the other hand, the use of concentrations above 2M will cause a simultaneous electrodeposition of the metals, i.e., one layer consisting of two or more metals. The concentration of the less noble metal is set as high as possible considering solubility data and maintaining the minimum potential gap mentioned above.

In the electrodeposition according to the present invention, layers are formed in thickness up to twenty times that of the crystal lattice parameter of the metal. The layers are alternately composed of the noblest metal and the less noble metals with a controlled level of presence of more noble metal in the layers of less noble metal, according to the following equation:

$$p_m=(I_L/I_T(\eta)\ 100$$

wherein:

$P_M$=the concentration of the noblest metal in the layer of less noble metal expressed, in % grain equivalents;

$I_L$=the limiting current density for the noblest metal electrodeposition depending on metal concentration and agitation;

$I_T$=the total current density applied during the electrodeposition of the less noble metal layer; and $\eta$=cathodic efficiency.

When the ratio ($I_L/I_T$) is much less than 1, the $P_m$ tends toward zero, which means that the less noble metal layer can be formed practically pure.

The anions of the metal salts in the bath from which the electrochemically modulated structure is formed, may be selected from the common anions used for this technique in electrochemical processes. Examples of particular anions are: sulfate, sulfamate, pyrophosphate, cyanide and chloride. The known additives generally utilized in the electrodeposition of a metal, such as ammonium tartrate ammonia (as buffer) or pyrophosphates, and surface active agents, such as dodecyl sulfate, will also be desirably incorporated.

The pH suitable for the electrodeposition according to the present invention, may be in a broad range, preferably being above 1. At a pH below 1, the method would still be applicable but a low deposition efficiency will result due to excessive hydrogen evolution. The most preferred pH range is between 2 and 3.

The temperature which prevails during the electrodeposition according to the present invention, is that normally utilized in the usual electrodeposition, ranging from 25 to 90 degrees C. It was found that an increase in temperature will cause a decrease in the concentration of the noblest metal electrodeposition at high current densities.

According to a most preferred embodiment, agitation is carried out during the elecrodeposition of the noblest metal, and towards the end of its deposition the agitation is stopped and the electrodeposition of the less noble metal is carried out without any agitation. In this manner, the degree of purity of the metal layers deposited will be the highest possible. As known from the electroplating technique, the agitation assists in obtaining uniform conditions and results in achieving high rates of deposition. The process can also be performed without agitation but will then require a longer deposition time.

Among the most preferred metals to be electrodeposited the following are mentioned: copper and nickel, copper and palladium, nickel-gold, copper-nickel-iron and corresponding alloys with cobalt or iron replacing nickel. All the above combinations of metals are characterized by a gap of a potential of at least 0.1 V between the noblest metal and the less noble metal which is one of the requirements of the present method.

One of the critical parameters found to be required according to the present invention, is the concentration of the noblest metal in the solution to be in the range of 0.001M to 2M and preferably in the range of between 0.005M to 1M. At this concentration, the limiting current density is low enough to ensure dilution of this metal in the layers of the other metal so that the latter can be produced practically pure. The concentration of the less noble metal is set as high as practicable to obtain the desired layer thickness, being preferably near the saturation.

The frequency utilized in the electrodeposition operation should be between 0.02 and 15 Hz and preferably in the range of between 0.15 to 2 Hz. The potential is pulsed at this frequency between a first value which is selected so to be between the redox potentials of its two metals and a second value more which is selected so as to be substantially negative than that of the less noble metal. The ratio of pulse durations is determined by the desired layer thickness as related to the electrical charge passed during each pulse. The pulsing can alternatively be done by current control if the relationship between electrode potential and current density is previously determined.

The present invention is applicable for the production of metal alloy sheets or rods or any other desired form combined of two or more metals which are structured as discrete layers of the substantially pure components, and in particular to layers with thickness which vary from 2 Angstroms to 90 Angstroms and preferably between 10 to 50 Angstroms. The total thickness of the formed alloy is optional. The layers of the metals which are electrodeposited are substantially pure, and form an integral and coherent structure of unique properties such as high modulus of elasticity, high and adjustable magnetic susceptibility and excellent corrosion resistance especially against pitting and other types of localized attack.

It was found that the modulated structure of compositional modulated ordered alloys according to the present invention causes an increase in the elastic modulus, compared with the homogeneous alloys. This increase depends on several parameters:

(a) wavelength of the modulation;

(b) average composition of the alloy; and (c) modulation's amplitude.

The elastic modulus was measured by bulge testing on Cu-Ni thin films containing short wavelength composition modulation and was compared to that of pure copper specimens and homogeneous alloys of Cu-Ni. The following results illustrate the improved properties of the compositional modulated thin films obtained.

The elastic modulus (Y) of pure copper specimen is:

$$Y=0.26\ Tpa$$

For homogeneous Cu-Ni specimen:

$Y=0.33\ Tpa,$ wherein $1\ Tpa=145\times10^6$ psi.

The elastic modulus for the composition modulated alloy according to the present invention, obtained at a wavelength of 17 Å, containing 45% Cu, was Y=0.87 Tpa.

The magnetization density (M) of modulated Cu-Ni thin films, obtained at a wavelength of 30 Å, was produced from ferromagnetic resonance data. It was found that M increased as the temperature decreases. At 125° K., M is significantly greater than that of pure Ni. For modular Cu-Ni foils that have been annealed to a homogeneous alloy, it was found that M decreased by an order of magnitude which indicates that the modulation contributes to the magnetization density.

According to another embodiment, a very thin foil of Ni (about 200 Å) is attached to a magnetic electrode and immersed in a plating bath containing a solution consisting of Cu and Ni. The modulated deposit of Cu-Ni built onto the foil, to approximately 3000 Å thickness, possesses magnetic properties and could be easily detached as a foil product. Furthermore, the magnetic properties could be tailored to desired levels by controlling the level of alloying of the less noble metal layers or the total alloy content.

While the invention will now be fully described in connection with certain preferred embodiments in the following Examples, it will be understood that it is not intended to limit the invention to these particular embodiments or metals. On the contrary, it is intended to cover all alternatives, modifications and equivalents as may be included within the scope of the invention as defined by the appended claims. Thus the following Examples which include preferred embodiments will serve to illustrate the practice of this invention, it being understood that the particulars described are by way of examples and for purposes of illustrating discussion of preferred embodiments of the present invention only and are presented to provide what is believed to be the most useful and most readily understood description of the procedure as well as of the principles and conceptual aspects of the invention.

EXAMPLE 1

Into an electroplating bath connected to a pulsed current, the following solutions were introduced:

$NiSO_4.6H_2O$: 330 g/l,
$NiCl_2.6H_2O$: 45 g/l,
$H_3BO_3$: 35 g/l,
$CuSO_4.5H_2O$: 0.4 g/l.

The temperature of the bath was kept at about 58 degrees C., the pH being between 2 to 3.0. The frequency was 0.16 Hz at a ratio $1:8\times10^{-3}$ between −0.4 and 1.12 V on the calomel scale. The thickness of each layer was 17 Angstroms, the total thicknesses being about 1 micron. The total time for the above electrodeposition was about 25 minutes. The foil obtained had an elasticity modulus of above 250% greater than the homogeneous alloy with the same average composition.

EXAMPLE 2

The same experiment as above was repeated. The bath composition was as follows:

$NiSO_4.6H_2O$: 330 g/l
$NiCl_2.6H_2O$: 45 g/l
$H_3BO_3$: 35 g/l
$CuSO_4.5H_2O$: 3 g/l

Sodium dodecyl sulfate and coumarin: 0.1 g/l each. Strong agitation was employed only during the copper deposition. Alternate potentiostatic pulses of 0.2 V and 1.7 V on the normal hydrogen scale (or alternatively galvanostatic current pulses of 5 mA/cm$^2$ and 200 mA/cm$^2$) were imposed. The frequency was 1 Hz at a ratio of 1:0.025 respectively.

We claim:

1. A method for the electrodeposition of an ordered alloy consisting of substantially pure layers of one metal alternating with substantially pure layers of another metal, comprising:

forming an electrodeposition bath in an electrodeposition apparatus including an anode and a cathode, said bath comprising a solution of two metals chosen such that the redox potential gap between the more noble metal and the less noble metal is at least 0.1 V, wherein the concentration of the more noble metal ion in said bath is in the range of 0.001 to 1.0 M and the concentration of the less noble metal ion in said bath is substantially greater than that of the more noble metal ion;

applying a potential to the cathode of said both at a first value which is selected so as to be between the potentials at which the metals begin to deposit under the conditions used, for a sufficient time to deposit less than 90 angstroms thickness of substantially pure more noble metal;

changing the potential applied to the cathode to a second value which is selected so as to be substantially more negative than the potential at which the less noble metal begins to deposit under the conditions used, said potential being sufficiently negative that the total current density is so much higher than the limiting current density for the more noble metal that the percent of more noble metal in the less noble metal layer approaches zero, thereby permitting deposition of substantially pure less noble metal, said potential being applied for a sufficient time to deposit less than 90 angstroms thickness of said substantially pure less noble metal; and repeating said applying and changing steps for a predetermined number of cycles to obtain a corresponding number of layers of said metals.

2. A method in accordance with claim 1 wherein the concentration of the less noble metal in said bath is near the level of saturation thereof in said bath at room temperature.

3. A method in accordance with claim 1 wherein the anions, in said bath, of the metals to be electrodeposited are selected from the group consisting of sulfate, sulfamate, pyrophosphate, cyanide and chloride.

4. A method in accordance with claim 1 wherein the pH during the electrodeposition is maintained above 1.

5. A method in accordance with claim 4 wherein the pH during the electrodeposition is between 2 and 3.

6. A method in accordance with claim 1 wherein the temperature during the electrodeposition is maintained in the range of 25°–90° C.

7. A method in accordance with claim 1 wherein the components of the bath are agitated during the electrodeposition.

8. A method in accordance with claim 1 wherein the components of said bath are agitated only during the step of depositing said substantially pure more noble metal.

9. A method in accordance with claim 1 wherein the metals being electrodeposited are copper and nickel.

10. A method in accordance with the claim 1 wherein the times of applying the potentials during said applying and changing steps are selected such that the layers of metals have a thickness of 2 to 50 Angstroms each.

* * * * *

UNITED STATES PATENT AND TRADEMARK OFFICE

CERTIFICATE OF CORRECTION

PATENT NO. : 4,652,348

DATED : March 24, 1987

INVENTOR(S) : Joseph Yahalom and Ori Zadok

It is certified that error appears in the above-identified patent and that said Letters Patent is hereby corrected as shown below:

Column 4, line 51, after "alloys", add --such as those produced--;
line 63, delete "the" and "obtained".
Column 5, line 8, delete "the" before "composition";
line 9, delete "alloy" and insert therefore --alloys such as those produced--;
line 62, delete "had" and insert --will have--.

Signed and Sealed this

Fifteenth Day of September, 1987

*Attest:*

DONALD J. QUIGG

*Attesting Officer*

*Commissioner of Patents and Trademarks*